US008614610B2

(12) United States Patent
Hacker et al.

(10) Patent No.: US 8,614,610 B2
(45) Date of Patent: Dec. 24, 2013

(54) RUGGEDIZED WAVEGUIDE ENCAPSULATION FIXTURE FOR RECEIVING A COMPRESSED WAVEGUIDE COMPONENT

(75) Inventors: Jonathan Hacker, Thousand Oaks, CA (US); Chris Hillman, Newbury Park, CA (US); Mark Field, Campbell, CA (US); Robert L. Borwick, III, Thousand Oaks, CA (US)

(73) Assignee: Teledyne Scientific & Imaging, LLC, Thousand Oaks, CA (US)

( * ) Notice: Subject to any disclaimer, the term of this patent is extended or adjusted under 35 U.S.C. 154(b) by 412 days.

(21) Appl. No.: 12/877,059

(22) Filed: Sep. 7, 2010

(65) Prior Publication Data

US 2012/0057839 A1 Mar. 8, 2012

(51) Int. Cl.
*H01P 3/12* (2006.01)

(52) U.S. Cl.
USPC ..... 333/248; 333/254

(58) Field of Classification Search
USPC ..... 333/239, 248, 254
See application file for complete search history.

(56) References Cited

U.S. PATENT DOCUMENTS

| | | | | |
|---|---|---|---|---|
| 2,829,351 | A * | 4/1958 | Fox | 333/239 |
| 4,239,334 | A | 12/1980 | Johnson | |
| 4,627,687 | A | 12/1986 | Dorn et al. | |
| 5,604,469 | A * | 2/1997 | Ishikawa et al. | 333/1.1 |
| 5,629,657 | A | 5/1997 | Bayorgeon et al. | |
| 5,917,232 | A * | 6/1999 | Tanizaki et al. | 257/664 |
| 6,882,253 | B2 * | 4/2005 | Okamura et al. | 333/239 |
| 7,592,887 | B2 | 9/2009 | Chao et al. | |
| 8,058,955 | B2 * | 11/2011 | Ko | 333/248 |

* cited by examiner

*Primary Examiner* — Benny Lee
(74) *Attorney, Agent, or Firm* — Snell & Wilmer LLP

(57) ABSTRACT

A waveguide component encapsulation device may include a housing having first and second surfaces, the housing defining a channel extending through the first and second surfaces, a micromachined waveguide component configured to be positioned in the channel, the waveguide component having first and second ends extending outside the channel and beyond the first and second surfaces of the housing by a finite length, and a pair of spacing members configured to align and stabilize the waveguide component within the channel.

20 Claims, 16 Drawing Sheets

RUGGEDIZED WAVEGUIDE ENCAPSULATION FIXTURE FOR RECEIVING A COMPRESSED WAVEGUIDE COMPONENT

STATEMENT REGARDING GOVERNMENT RIGHTS

This invention was made with Government support under Contract No. G.O. 71325 awarded to Rockwell Scientific Company, LLC (now known as Teledyne Scientific & Imaging, LLC) by the U.S. Army Research Development and Engineering Command (RDECOM) Army Research Laboratory (ARL) on behalf of the Microsystems Technology Office (MTO) and the Defense Advanced Research Projects Agency (DARPA) THz Electronics Program and HiFive Program. The Government has certain rights in this invention.

BACKGROUND

1. Field

The present invention relates generally to the field of waveguide encapsulation fixture, and more particularly to the fabrication of a ruggedized waveguide encapsulation fixture for use in high frequency circuits operating in the millimeter-wave and submillimeter-wave bands.

2. Description of Related Art

Demand for high precision and high frequency waveguide continues to grow, driven primarily by strong growth in the markets for high frequency circuits that operate at frequencies ranging from millimeter-wavelengths (MMW) up to several terahertz (THz). Although conventional commercial rectangular waveguides (WGs) can be machined to fine tolerances using very high precision ultrasonic computers, these conventional WGs and the fabrication process thereof suffer from several drawbacks. For example, the milling process is slow, serial, and requires manual operation by expert machinists. For another example, the metal machined WGs suffer from precision limitations, which are generally greater than 10 μm.

Attempts have been made in the past to use micromachined WGs to replace the conventional machined WGs because micromachined WGs are easier to fabricate and can deliver high frequency signals in a more precise manner. More particularly, silicon micromachined WGs have demonstrated promising qualities in the field of ultra-high frequency circuits, which operate at a frequency greater than 30 GHz. Nevertheless, the silicon micromachined WGs are difficult to deploy because of their thin cross-sections and fragile properties. When connected to an external WG component, the silicon micromachined WGs may not withstand the connecting force or coupling force, such that they are highly susceptible to breakage.

Thus, there is a need for a ruggedized waveguide encapsulation fixture for supporting and protecting the delicate micromachined WGs, so that the micromachined WGs may readily be deployed in connecting a MMW or THz circuit to an external waveguide component.

SUMMARY OF THE INVENTION

One aspect of the present disclosure is to provide a waveguide encapsulation device that may ruggedize and encapsulate a high frequency waveguide component, which may operate at a frequency range above 30 GHz. The waveguide encapsulation device may be a rigid metal flange adapter for interfacing and connecting other external waveguide components. Another aspect of the present disclosure is to provide good conductivity, connectivity and alignment between the waveguide component and a traditional commercial waveguide flange. Yet another aspect of the present disclosure is to shield and protect the waveguide component from a connecting force or a coupling force between the waveguide encapsulation device and an external flange.

In one implementation, the waveguide component encapsulation device may include a housing having a first surface, the housing defining a channel extending through the first surface, and a waveguide component configured to be positioned in the channel, the waveguide component having a first end extending outside the channel and beyond the first surface of the housing by a finite length.

In another implementation, the waveguide component encapsulation device may include a housing having first and second surfaces, the housing defining a channel extending through the first and second surfaces, a micromachined waveguide component configured to be positioned in the channel, the waveguide component having first and second ends extending outside the channel and beyond the first and second surfaces of the housing by a finite length, and a pair of spacing members configured to align and stabilize the waveguide component within the channel.

In yet another implementation, the waveguide component encapsulation device, for use in conjunction with a flange having a flange surface and a connection port, may include a first fixture having a plurality of first surfaces, the first fixture defining a first trench extending through at least one of the plurality of first surfaces, a second fixture having a plurality of second surfaces, the second fixture defining a second trench extending through at least one of the plurality of second surfaces, means for securing the first fixture to the second fixture, the first and second trenches combining to define a channel, and the first and second fixtures combining to form a front surface such that the channel extends through the front surface, a waveguide component disposed within the channel, the waveguide component having a contact portion extending outside of the channel and beyond the front surface by a finite length, first and second spacers configured to align and stabilize the waveguide component inside the channel, the first spacer inserted between the first fixture and the waveguide component, the second spacer inserted between the second fixture and the waveguide component, and means for securing the waveguide component encapsulation device to the flange, the contact portion of the waveguide component configured to be coupled to the connection port of the flange such that the front surface of the waveguide component encapsulation device is substantially in contact with the flange surface of the flange.

BRIEF DESCRIPTION OF THE DRAWINGS

Other systems, methods, features and advantages of the present disclosure will be or will become apparent to one with skill in the art upon examination of the following figures and detailed description. It is intended that all such additional systems, methods, features and advantages be included within this description, be within the scope of the present disclosure, and be protected by the accompanying claims. Component parts shown in the drawings are not necessarily to scale, and may be exaggerated to better illustrate the important features of the present disclosure. In the drawings, like reference numerals designate like parts throughout the different views, wherein:

DETAILED DESCRIPTION OF THE INVENTION

Apparatus, systems and methods that implement the implementation of the various features of the present disclosure will now be described with reference to the drawings. The drawings and the associated descriptions are provided to illustrate some implementations of the present disclosure and not to limit the scope of the present disclosure. Throughout the drawings, reference numbers are re-used to indicate correspondence between reference elements. In addition, the first digit of each reference number indicates the figure in which the element first appears.

Figure 1A:
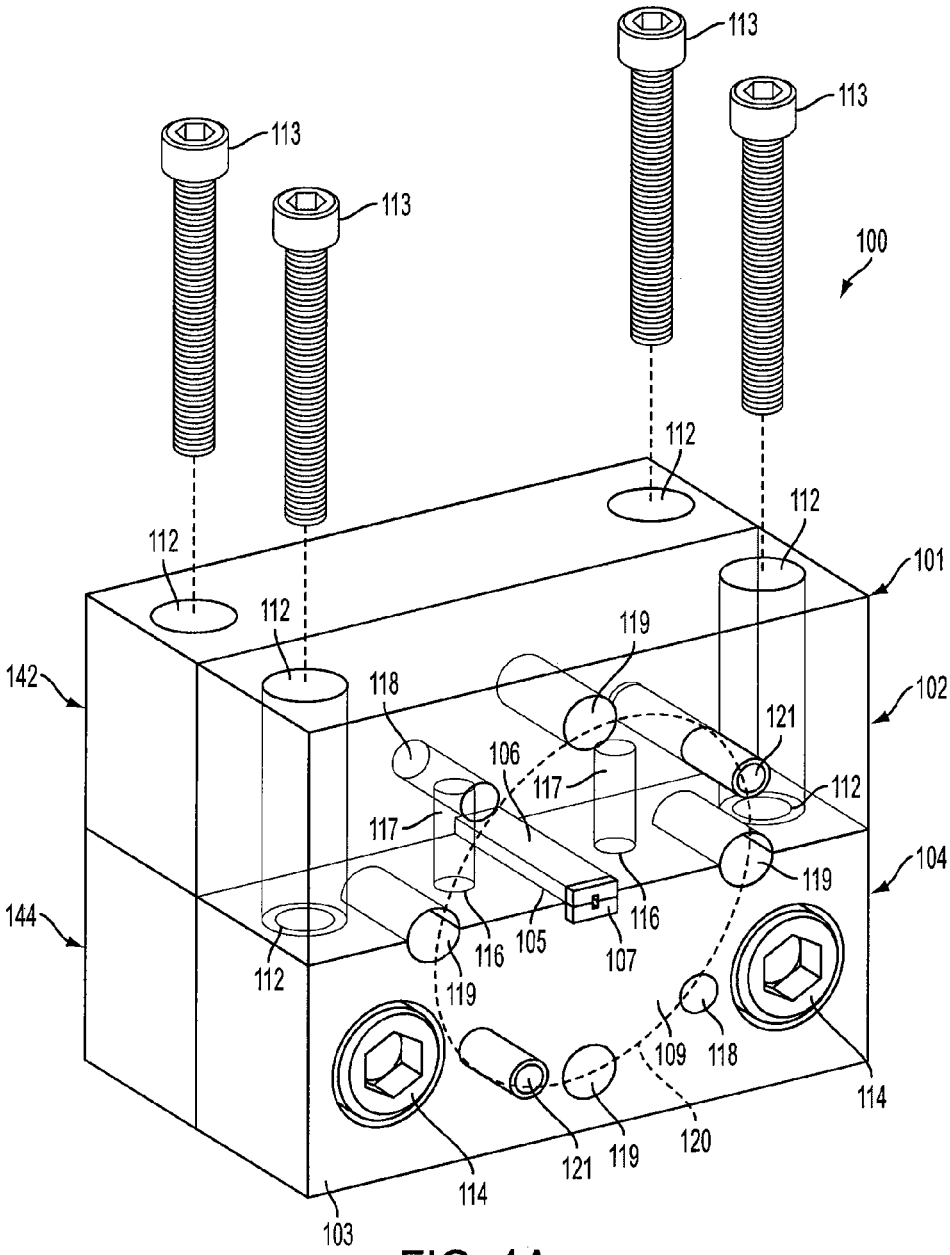
FIGS. 1A and 1B show a perspective view and an exploded view of a waveguide encapsulation device (WGED) according to an implementation of the present disclosure.
Figure 1B:
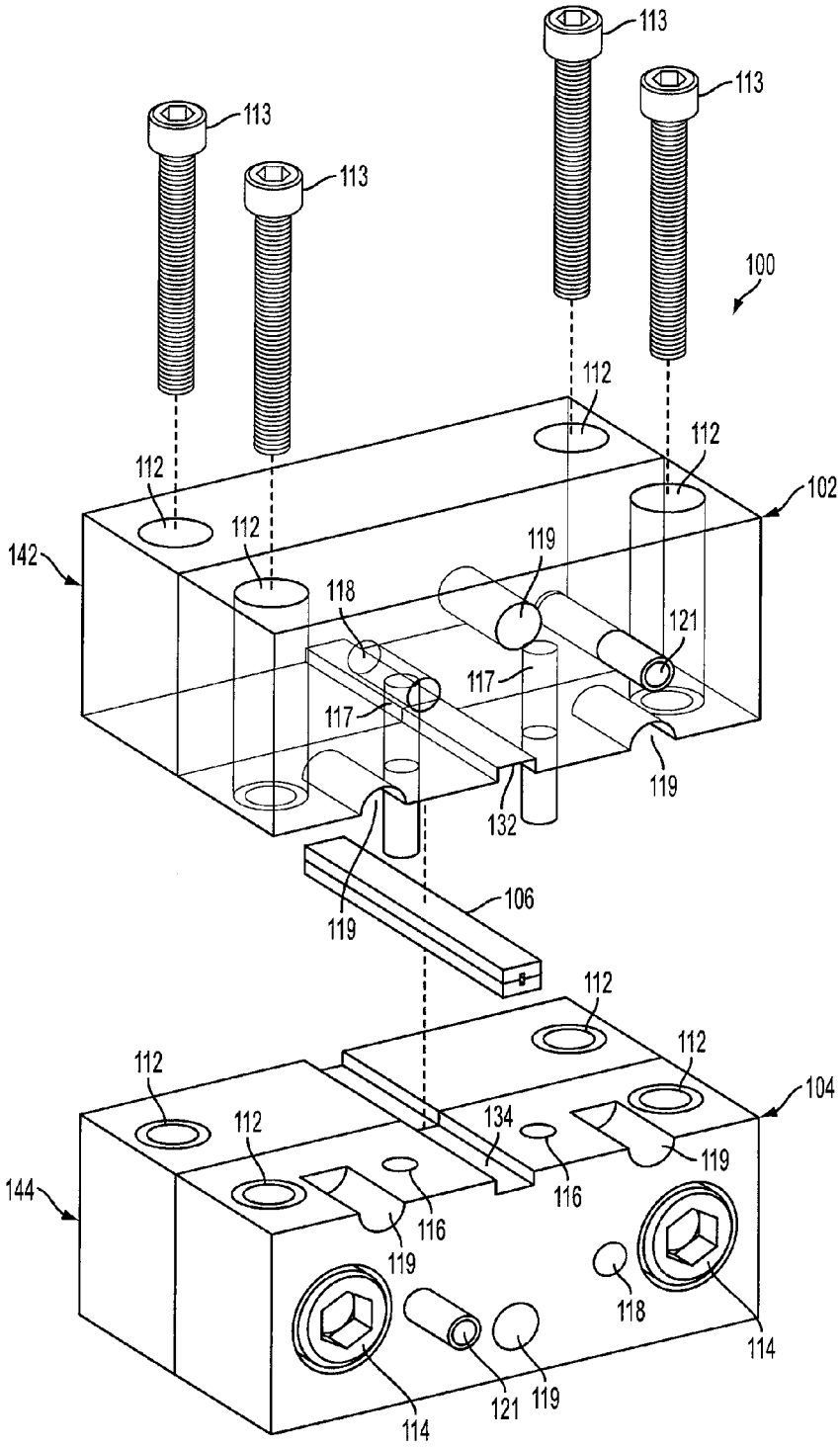

FIGS. 1A and 1B show a perspective view and an exploded view, respectively, of a waveguide encapsulation device (WGED) 100 according to an implementation of the present disclosure. In general, the WGED 100 may have a housing 101 and a waveguide component 106 encapsulated within the metal housing. As shown in FIGS. 1A and 1B, the metal housing 101 may be a split-block fixture having a first (top) fixture 102 and a second (bottom) fixture 104. Alternatively, the metal housing 101 may be a single-block fixture (not shown) according to another embodiment of the present invention. In either case, the housing 101 provides a rigid structure that may protect the waveguide component 106 from external forces. According to various embodiments of the present invention. The housing 101 may be made of rigid metals, plastics, alloy, and/or composites.

In a split-block configuration, each of the first and second fixtures 102 and 104 may have several alignment holes 116 for holding several alignment pins 117. Moreover, the first fixture 102 may have a first trench 132, and the second fixture may have a second trench 134 as shown in FIG. 1B. When the several alignment pins 117 are inserted into the several alignment holes 116 of both the first and second fixtures 102 and 104, the first and second fixtures 102 and 104 may be properly aligned. After the first and second fixtures 102 and 104 are properly aligned, they may be secured by inserting a pair of screws 113 into a pair of sockets 112 of both the first and second fixtures 102 and 104. Consequently, the first and second trenches 132 and 134 may be combined to form a precision channel 105 as shown in FIG. 1A.

Although FIGS. 1A and 1B show that the first and second fixtures 102 and 104 are aligned by using several alignment pins 117 positioned in several alignment holes 116, the first and second fixtures 102 and 104 may be aligned by other alignment means. For example, the first and second fixtures 102 and 104 may be aligned by using alignment tracks and or alignment rails according to another implementation of the present disclosure. Moreover, although FIGS. 1A and 1B show that the first and second fixtures 102 and 104 are combined and secured by a pair of screws 113, they may be secured by other means as well. For example, the first and second fixtures 102 and 104 may be combined and secured by a mechanical lock, a mechanical brace, or a mechanical fastener. For another example, the first and second fixtures 102 and 104 may be combined and secured by applying glue therebetween or by soldering the first and second fixtures 102 and 104.

The waveguide component 106 may be inserted into the precision channel 105 after the first and second fixtures 102 and 104 are combined or secured. Alternatively, the waveguide component 106 may be placed in and aligned with the second trench 134 before the first fixture 102 is aligned and combined with the second fixture 104. In either case, the precision channel 105 should have dimensions that allow the waveguide component 106 to be adaptively positioned within the precision channel 105.

Moreover, the precision channel 105 should have a configuration that allows a contact portion or a first end 107 (FIG. 1A) of the waveguide component to extend beyond a first (front) surface 103 (FIG. 1A) of the housing 101. That is, the precision channel 105 should penetrate or extend through at least one surface of the housing 101 such that the waveguide component 106, positioned therein, may have the contact portion 107 extended proud of or outside of the housing 101. For example, the contact portion 107 of the waveguide component 106 may extend beyond the first surface 103 of the housing 101 for about 2 μm to about 12 μm. According to another embodiment of the present invention, the contact portion 107 of the waveguide component 106 may extend beyond the first surface of the housing 101 for about 5 μm.

To properly interface with an external flange (not shown), the first surface 103 of the housing 101 may have an access outlet 109 (FIG. 1A), which may include a bolt circle 120 (FIG. 1A), several external alignment holes 118 for holding several external alignment pins 121, and several adaptive sockets 119 for receiving several adaptive screws (not shown) when the housing 101 is secured to the external flange (not shown). More specifically, the bolt circle 120 may match a flange surface of the external flange, which can be a standard UG-387/U flange, and the external alignment pins 121 may properly align the external flange to the housing 101. Alternatively, the first surface 103 may adopt other mechanical means for aligning and securing other types of external flange according to various embodiments of the present invention.

The waveguide component 106 may be slidingly inserted in the precision channel 105 and secured therein according to an implementation of the present disclosure. Alternatively, the waveguide component 106 may be bonded to the surfaces of the precision channel 105 according to another implementation of the present disclosure. For example, the waveguide component 106 may be bonded to the precision channel 105 by using some common die attach materials such as epoxy, solder, and A-Au thermo-compression bonding.

In any event, the housing 101 should shield and protect the waveguide component 106 from external forces, such that the waveguide component 106 is less susceptible to breakage when it is coupled to the external flange. Although the contact portion 107 of the waveguide component 106 extends beyond the first surface 103 of the housing 101, it receives only a fraction of the coupling force that secures the housing 101 to the external flange. Mainly, the extension of the contact portion 107 is in the range of micrometers, which is relatively small in comparison to the contact area between the first surface 103 and the external flange. As a result, the first surface 103 of the housing may absorb most of the coupling force, thereby protecting the waveguide component from breakage.

As shown in FIGS. 1A and 1B, the housing 101 may have two additional (third and fourth) fixtures 142 and 144 for extending the first and second fixtures 102 and 104. The third and fourth fixtures 142 and 144 may be secured to the first and second fixtures 102 and 104 by applying the optional screws 114. Structurally, the third and fourth fixtures 142 and 144 may be similar to the first and second fixtures 102 and 104. For example, the third and fourth fixtures 142 and 144 may have a third and a fourth trenches (not shown), the combination of which may form an extended portion of the precision channel 105. Alternatively, the third and fourth fixtures 142 and 144 may have a different configuration from the first and second fixtures 102 and 104. For example, the first and fourth fixtures 142 and 144 may have no trench at all, such that the precision channel 105 of the first and second fixtures 102 and 104 may end at the contact surface between the first and second fixtures 102 and 104 and the third and fourth fixtures 142 and 144.

Although FIGS. 1A and 1B show that the split-block configuration of the housing is implemented by the top (first) and bottom (second) fixtures 102 and 104, the split-block configuration may be implemented by a left (first) and right (second) fixture accordingly to another implementation of the present disclosure. Moreover, the split-block configuration of the housing 101 is not limited to fixtures with rectangular shapes and it can be implemented with fixtures having other shapes as long as the housing 101 has a precision channel for positioning the waveguide component and a surface suitable for interfacing the external flange. For example, the fixtures may have a tubular shape, a planar shape, a cylindrical shape, a T-shape, a triangular shape, a pentagon shape and/or a curvy shape according to various implementations of the present disclosure.

Besides the split-block configuration, the housing 101 may adopt the single-block configuration, which may have a single fixture with a precision channel extended through at least one surface of the single fixture. Unlike the first and second fixtures 102 and 104 of the split-block configuration, the single fixture does not have any alignment hole, alignment pin, or socket because these features are not necessary for the single-block configuration. However, the single fixture may have a first surface similar to the first surface 103 of the split-block configuration, such that the housing 101 may be coupled to the external flange. Moreover, the waveguide component in the single-block configuration may be similar to the waveguide component 106 in the split-block configuration. Particularly, the waveguide component in the single-block configuration may either be slidingly inserted in the precision channel or bonded to the surfaces of the precision channel, and the waveguide component may have a contact portion extended outside of the housing 101 by a finite length in the range of a few micrometers.

Figure 2A:
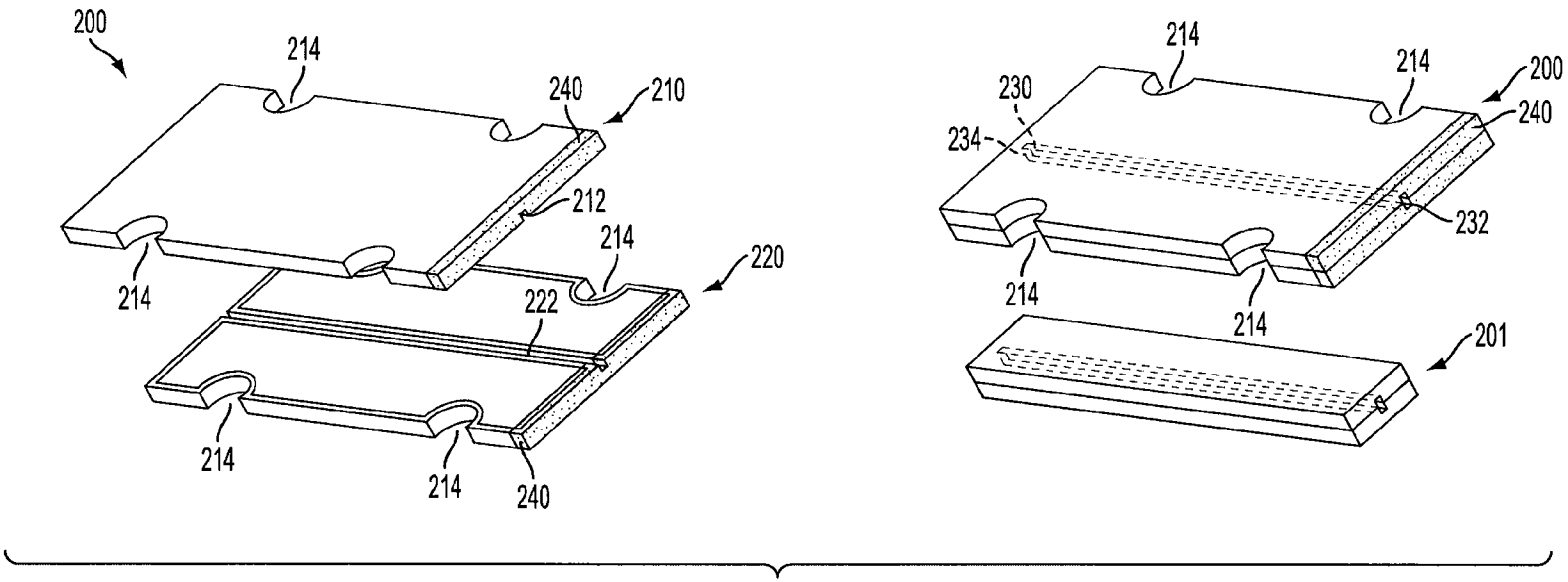
FIG. 2A shows an exploded view and a perspective view of a waveguide component according to an implementation of the present disclosure.

The discussion now turns to several configurations of the waveguide component. In FIG. 2A, an exploded view and a perspective view of the waveguide components are shown. Generally, the waveguide component 200 may be formed by first and second layers 210 and 220, both of which may be fabricated by using micromachined technology. The first and second layers 210 and 220 may be made from materials suitable for high frequency circuits, such as circuits that perform THz or MMW operations. For example, the first and second layers 210 and 220 may contain silicon, silica, quartz, alumina, silicon nitride, gallium arsenide, indium phosphide, other crystalline materials, and/or metalized plastics according to various embodiments of the present invention. In one embodiment, the waveguide component may be a silicon micromachined waveguide. In another embodiment, the waveguide component may be a gallium arsenide micromachined waveguide. In yet another embodiment, the waveguide component may be an indium phosphide micromachined waveguide.

The first and second layers 210 and 220 of the waveguide component 200 may have a first groove and a second groove 212 and 222 respectively. When the first layer 210 is placed on top of or bonded to the second layer 220, the first and second grooves combined to form a conduit 230 for conducting high frequency electromagnetic waves. The conduit 230 may extended through the first end 232 and the second end 234 of the waveguide component 200. According to an implementation of the present disclosure, either the first or second end 232 or 234 of the waveguide component 200 may be the contact portion 107 as discussed in FIGS. 1A and 1B. According to another implementation of the present disclosure, both the first and second ends 232 and 234 may be the contact portion 107 as depicted in FIGS. 1A and 1B.

In general, the end of the waveguide component that is designated as the contact portion 107 may be coated with a metallic layer 240 with a uniform thickness in a range of a few micrometers. For example, the metallic layer 240 may have a uniform thickness ranges from about 2 μm to about 12 μm according to an implementation of the present disclosure. For another example, the metallic layer 240 may have a uniform thickness of about 5 μm.

The purpose of the metallic layer 240 may be two folded. First, the metallic layer 240 may provide good conductivity and connectivity between the waveguide component 200 and a connection port (not shown) of the external flange. Second, the metallic layer 240 may act as a mechanical buffer for the waveguide component 200 for absorbing coupling pressure asserted by the connection port of the external flange. Because the metallic layer 240 is generally malleable, it may be temporarily compressed when the WGED 100 is coupled to the external flange, thereby forming a good conductive surface without damaging the waveguide component 200. Moreover, to provide a matching surface, the metallic layer 240 may extend internally throughout the surface of the conduit 230, however, the thickness of the metallic layer disposed inside of the conduit 230 may vary and it may depend on the cross-sectional space of the conduit 230. The waveguide component 200 has a wide surface. In another implementation, a waveguide component 201 may have a narrow surface. As seen in FIG. 2A, the waveguide component 201 is narrower than the waveguide component 200.

Figure 2B:
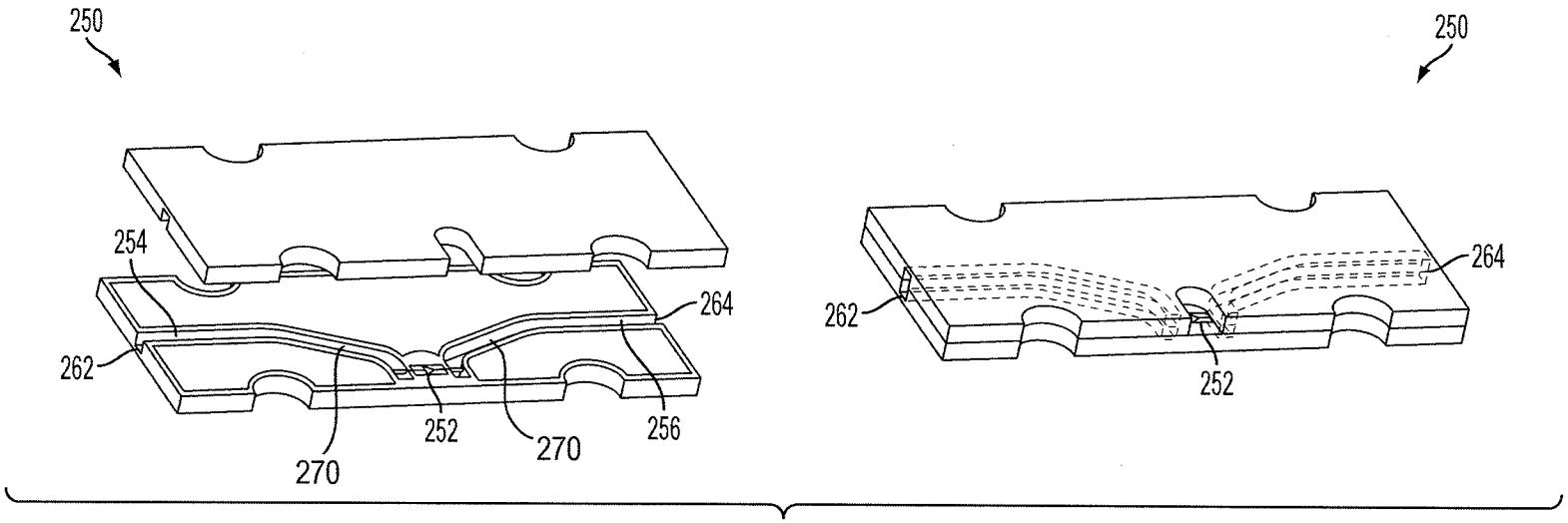
FIG. 2B shows an exploded view of a waveguide component embedded with an integrated circuit according to various implementations of the present disclosure.

The waveguide component may be embedded with one or more integrated circuits according to an implementation of the present disclosure. For example, FIG. 2B shows a waveguide component 250 embedded with an integrated circuit 252, which is coupled between a first conduit 254 and a second conduit 256. More specifically, the first conduit 254 may be coupled between the first end 262 of the waveguide component 250 and the integrated circuit 252 embedded inside the waveguide component 250. Similarly, the second conduit 256 may be coupled between the second end 264 of the waveguide component 250 and the integrated circuit 252. The integrated circuit 252 may be a filter, a mixer, a high-power travel wave tube (TWT) amplifier, an exciter, and/or an imaging system according to various implementations of the present disclosure.

Unlike the conduit 230 of the waveguide component 200 in FIG. 2A, which has the shape of a straight line, each of the first and second conduits 254 and 256 of the waveguide component 250 has a curve section 270. Moreover, unlike the conduit 230 of the waveguide component 200, which does not have any closed end, each of the first and second conduits 254 and 256 has a closed end abutting an edge of the waveguide component 250. Besides the conduit configurations as shown in FIGS. 2A and 2B, the waveguide component may have other conduit configurations according to various implementations of the present disclosure.

Figure 3A:
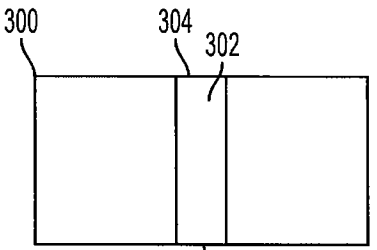
FIGS. 3A-3F show the top views of the waveguide component having various conduit configurations according to various implementations of the present disclosure.
Figure 3B:
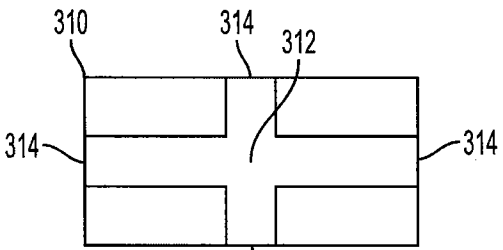
Figure 3C:
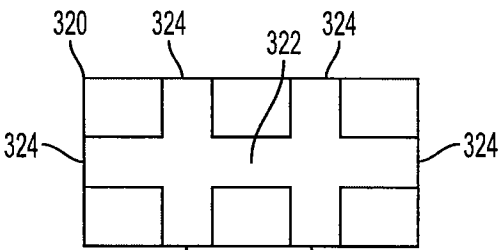

For example, FIGS. 3A to 3F show several top cross-sectional views of the waveguide component, illustrating that the waveguide component may have several conduit configurations. In FIG. 3A, the waveguide component 300 may have a conduit 302 across the wider sides of the waveguide component 300 with two open ports 304. In FIG. 3B, the waveguide component 310 may have a conduit 312, which has a cross-shape and extends through four sides of the waveguide component 310 with four open ports 314. In FIG. 3C, the waveguide component 320 may have a conduit 322, which has a double-cross-shape and extends through four sides of the waveguide component 320 with six open ports 324.

Figure 3D:
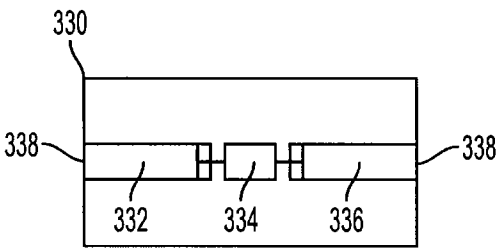
Figure 3E:
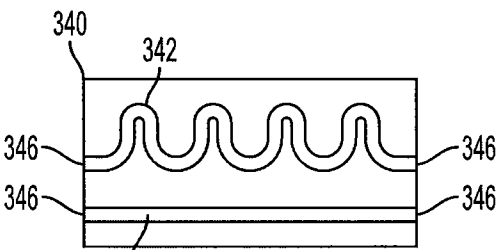
Figure 3F:
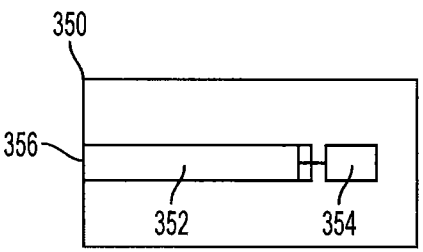

In FIG. 3D, the waveguide component 330 may have the first and second conduits 332 and 336 coupled to the integrated circuit 334. Each of the first and the second conduits 332 and 336 has a straight-line shape and coupled to open ports 338. In FIG. 3E, the waveguide component 340 may have a first conduit 342 and a second conduit 344. The first conduit 342 is longer in length than the second conduit 344 because the first conduit 342 has a curvy shape whereas the second conduit 344 has a straight-line shape. Each of the first and second conduits 342 and 344 extends through two sides of the waveguide component 340 with two open ports 346. In FIG. 3F, the waveguide component 350 may have the first conduit 352 coupled to the integrated circuit 354. Unlike the waveguide component 330 in FIG. 3D, the waveguide component 350 does not have the second conduit 336. As such, the waveguide component 350 only has one open port 356. The conduit configurations shown in FIGS. 3A-3F are for illustrative purpose, such that other conduit configurations are also possible depending on the application of the waveguide fixture.

Although various drawings disclosed herein illustrate that the waveguide component may be embedded with one integrated circuit, the waveguide component may be embedded with other electronic components and/or more than one integrated circuits. In one implementation, the waveguide component may be embedded with a resistor, a capacitor, and/or an inductor. In another implementation, the waveguide component may be embedded with two integrated circuits. In yet another implementation, the waveguide component may be embedded with one integrated circuit and a resistor, a capacitor and/or an inductor.

Referring again to FIGS. 2A and 2B, both waveguide components 200 and 250, respectively, may have several optional concave sections 214 for engaging the several alignment pins 117 of the housing 101 as shown in FIGS. 1A and 1B. The purpose of the optional concave sections 214 is to help align and stabilize the waveguide component within the precision channel 105 of the housing 101. When the optional concave sections 214 are properly engaging the alignment pins 117, the waveguide component becomes stationary to the housing 101 and may not slide in and out of the precision channel 105 freely.

Figure 4A:
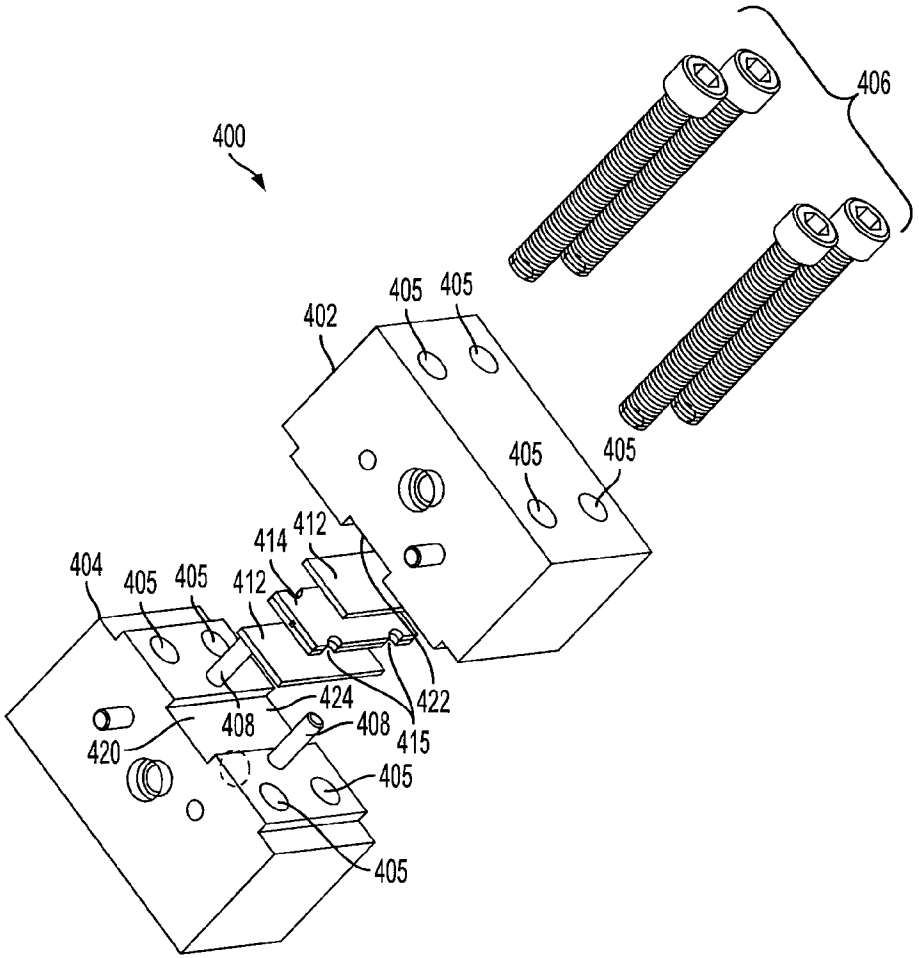
FIG. 4A shows an exploded view of a WGED with a pair of spacers according to an implementation of the present disclosure.
Figure 4B:
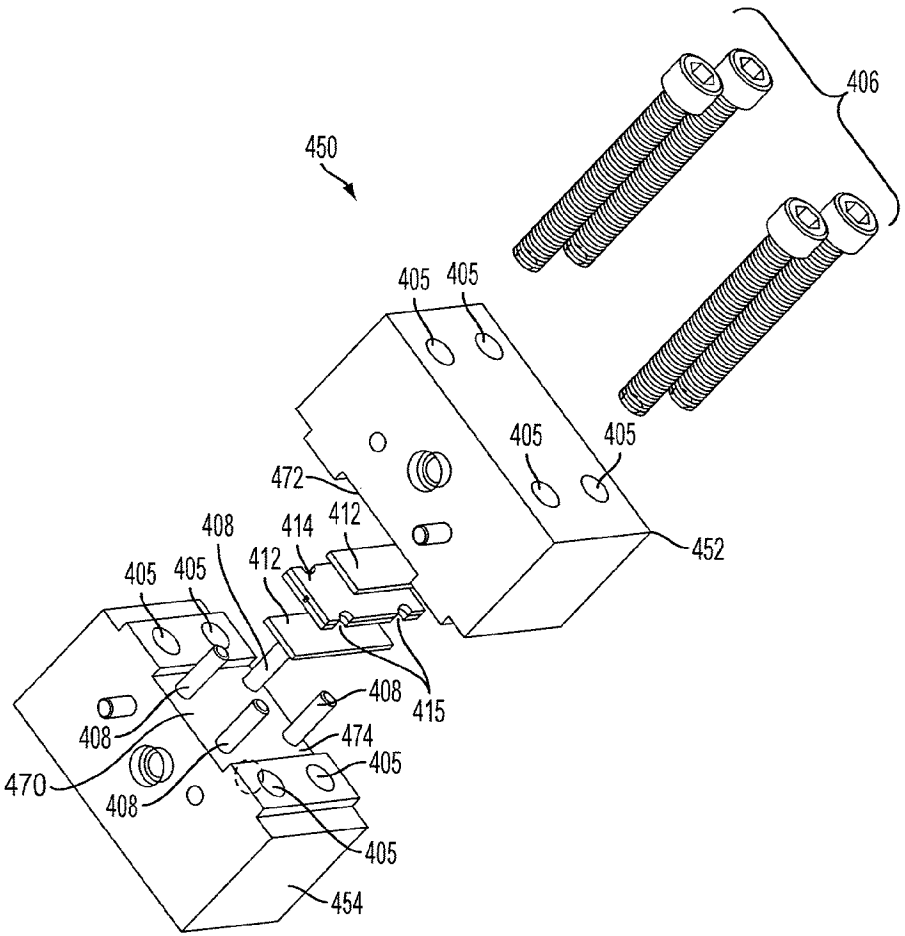
FIG. 4B shows an exploded view of a WGED with a pair of spacers according to an alternative implementation of the present disclosure.

FIGS. 4A and 4B further illustrate the internal configuration of the WGED 100 of FIGS. 1A and 1B. Referring to the WGED 400 in FIG. 4A, the first and second fixtures 402 and 404 may have the first and second trenches 422 and 424 respectively. When the first fixture 402 is secured to the second fixture 404 by engaging several screws 406 to several sockets 405, the precision channel 420 may be formed. Because the width of the waveguide component 414 fits well with the width of the precision channel 420, the concave sections 415 of the waveguide component do not engage any of the alignment pins 408. However, because the thickness of the waveguide component 414 is substantially less than the height of the precision channel 420, a pair of spacers (shims) 412 may be inserted between the waveguide component 414 and the first and second trenches 422 and 424. Accordingly, the waveguide component 414 may be secured and stabilized within the precision channel 420 because the pair of spacers 412 asserts sufficient frictions between the waveguide component 414 and the precision channel 420.

Referring to the WGED 450 in FIG. 4B, the first and second fixtures 452 and 454 are similar to the first and second fixtures 402 and 404 of FIG. 4A except that the first and second trenches 472 and 474 of the first and second fixtures 452 and 454 are much wider. As such, the several alignment pins 408 are located inside the first and second trenches 472 and 474. Because the waveguide component 414 has a width that is narrower than the width of the precision channel 470, the concave sections 415 of the waveguide component 414 may engage the alignment pins 408. In addition to the spacers 412, the concave sections 415, when properly engaging the alignment pins 408, provide extra means for stabilizing and securing the waveguide component 414 within the precision channel 470.

Generally, the spacers (shims) 412 may be made of the same material as the waveguide component 414. For example, the spacer 412 may contain silicon, silica, quartz, alumina, silicon nitride, gallium arsenide, and/or indium phosphide according to various implementations of the present disclosure. Although the spacers 412 are used in both the WGEDs 400 and 450 of FIGS. 4A and 4B, the spacers 412 may not be necessary if the waveguide component 414 is thick enough, such that the waveguide component 414 may be frictionally engaging the surfaces of the precision channels 420 and 470 respectively. Moreover, additional spacers (not shown) may be used in replacing the alignment pins 408 according to an alternative embodiment of the present invention.

Figure 5A:
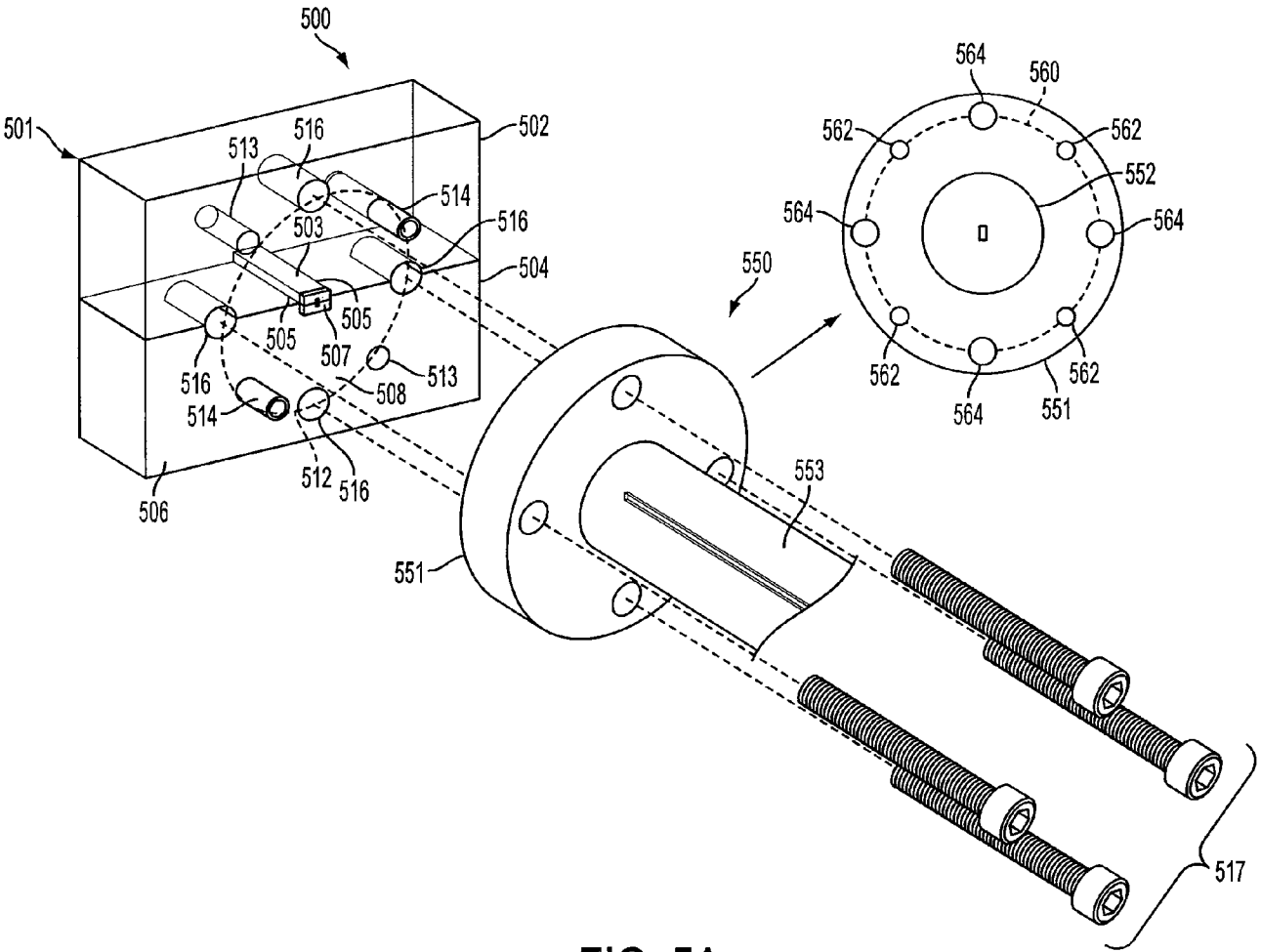
FIG. 5A shows a perspective view of a WGED mating with an external flange according to an implementation of the present disclosure.

The discussion now turns to the coupling between the WGED and the external flange. FIG. 5A shows a perspective view of the WGED 500 and the external flange 550. The WGED 500 can be one of the WGED 100 of FIGS. 1A and 1B, the WGED 400 of FIG. 4A, the WGED 450 of FIG. 4B, or any other WGED disclosed herein. The external flange 550 can be any standard commercial flange used for waveguide interconnection, such as the UG-387/U flange. Like the WGED 100, the WGED 500 may include the housing 501 and the waveguide component 503. The housing 501 may be a split-block fixture including the first and second fixtures 502 and 504. When the first and second fixtures 502 and 504 are secured together, they form the precision channel 505 for holding the waveguide component 503 and the first surface 506 for receiving a connection from the external flange 550. More specifically, the first surface 506 may have an access outlet 508, which includes the bolt circle 512, several external alignment holes 513 for holding several external alignment pins 514, several adaptive sockets 516 for receiving several external screws 517, and an open end of the precision channel 505. As shown in FIG. 5A, the contact portion 507 of the waveguide component 503 may extend beyond the open end of the precision channel 505 as well as the access outlet 508 of the first surface 506 by a few micrometers.

The external flange 550 may have a flange surface 551 and a connection port 552 located within the flange surface 551. The flange surface 551 may have a profile matching the layout of the access outlet 508 of the first surface 506 of the WGED 500. As such, the flange surface 551 may include a bolt circle 560, several alignment holes 562, and several sockets 564. The connection port 552 may be connected to a conventional waveguide 553 and it should be coupled to the contact portion 507 of the waveguide component 503 when the external flange 550 is secured to the WGED 500 by several external screws 517.

Figure 5C:
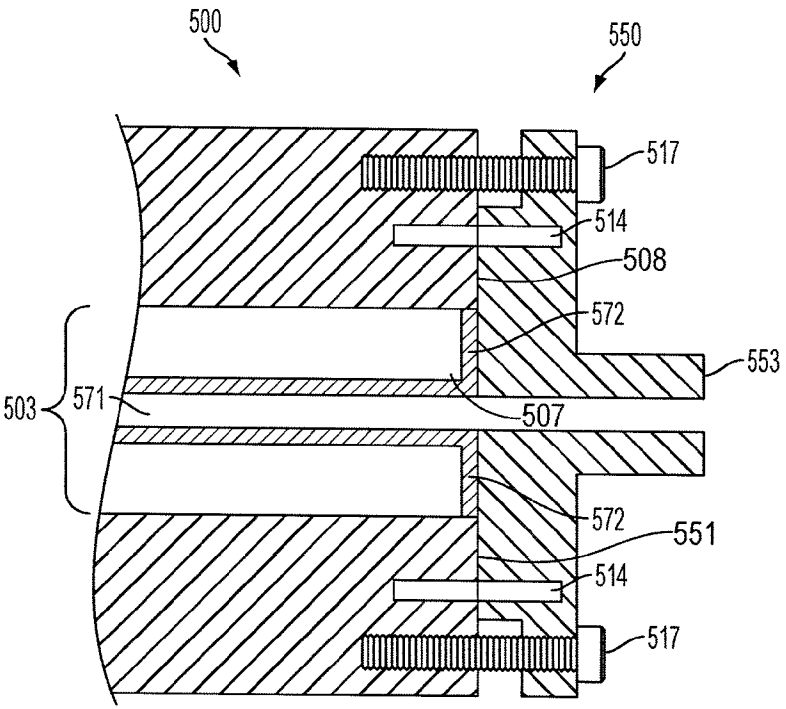
FIGS. 5B-5C show the cross-sectional views of a WGED and an external flange before and after they are coupled to each other according to an implementation of the present disclosure.
Figure 5B:
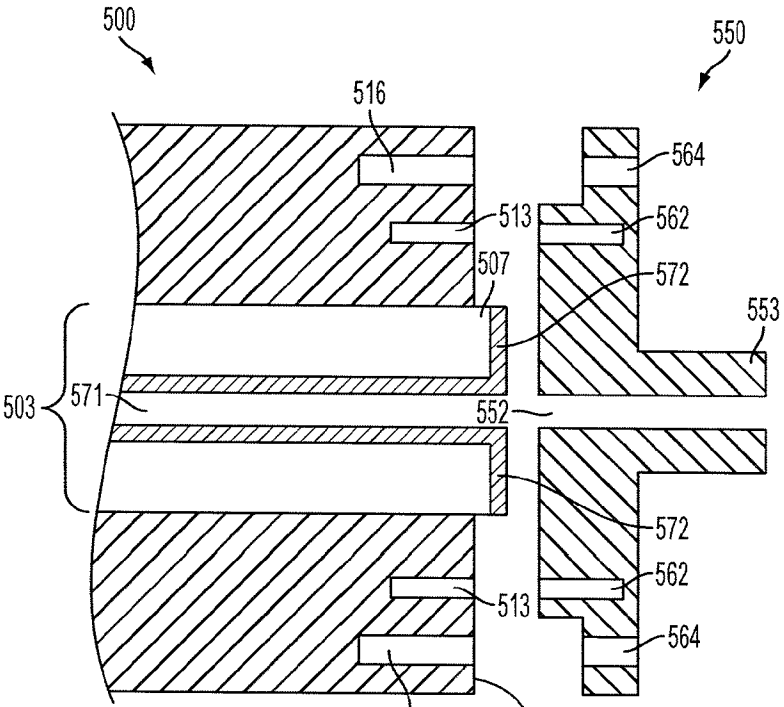

FIGS. 5B and 5C show the cross-sectional views of the WGED 500 and the external flange 550 before and after they are coupled to each other. In FIG. 5B, the waveguide component 503 may have the contact portion 507 extend beyond the first surface 506. A metallic layer 572 may be coated evenly on the front surface of the contact portion 507 according to an embodiment of the present invention. The metallic layer 572 may have a uniform thickness, such that the front surface of the metallic layer 572 is substantially parallel to the first surface 506 of the WGED 500 and the connection port 552 of the external flange 550. The metallic layer 572 may also be coated internally on the surface of the conduit 571 according to another embodiment of the present invention.

In FIG. 5C, the WGED 500 is aligned with the external flange 550 by applying several external alignment pins 514. After the WGED 500 is properly aligned with the external flange 550, several external screws 517 are inserted into the adaptive sockets 516 of the WGED 500 and the sockets 564, which are visible in FIG. 5B but obscured in FIG. 5C. When the external screws 517 secure the external flange 550 to the WGED 500, the contact portion 507 of the waveguide component 503 is coupled to the connection port 552 (FIG. 5B) of the external flange 550 via the metallic layer 572. Because the metallic layer 572 is malleable, it may be compressed by the coupling force asserted by the connection port 552 of the external flange 550. As a result, the metallic layer 572 provides a good conductive interface between the contact portion 507 of the waveguide component 503 and the connection port 552 of the external flange 550, while protecting the waveguide component 503 from excessive coupling force. Moreover, because the access outlet 508 of the WGED 500 is in substantial contact with the flange surface 551 of the external flange, it may absorb most of the coupling force, thereby further protecting the waveguide component 503. Ultimately, the conventional waveguide 553 of the external flange 550 may be coupled to the waveguide component 503 of the WGED 500.

Figure 6A:
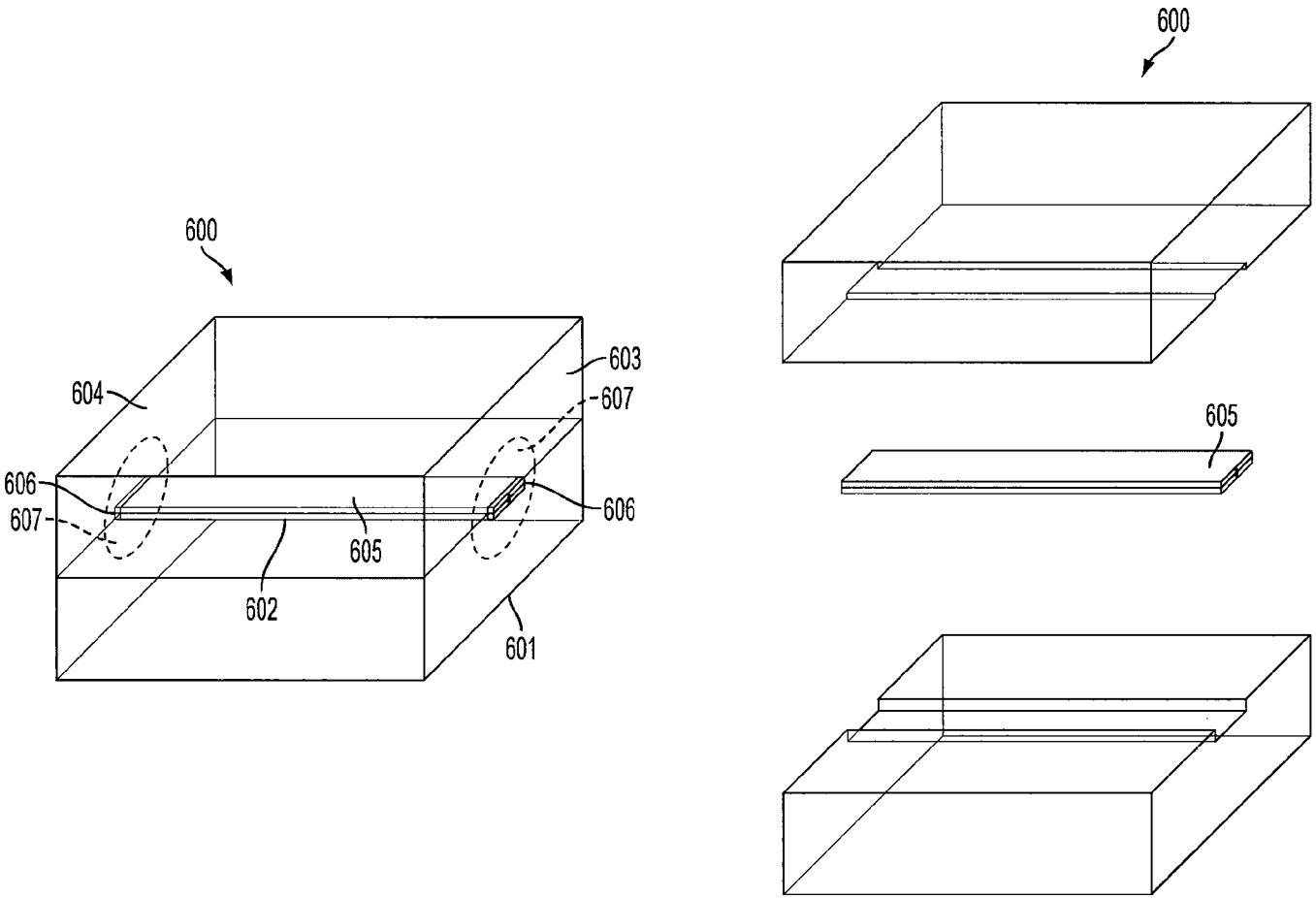
FIG. 6A shows a perspective view and an exploded view of a WGED with two access outlets according to an implementation of the present disclosure.

Although FIGS. 5A-5C show that the WGED 500 has one access outlet, the WGED may have more than one access outlet according to various implementations of the present disclosure. For example, FIGS. 6A-6E show that the WGED may have two, three, four, five, or six access outlets. In FIG. 6A, the WGED 600 may have a precision channel 602 extending through the first and second surfaces 603 and 604 of the housing 601. As such, the waveguide component 605 may have two contact portions 606 extended beyond the first and second surfaces 603 and 604, thereby forming two access outlets 607.

Figure 6B:
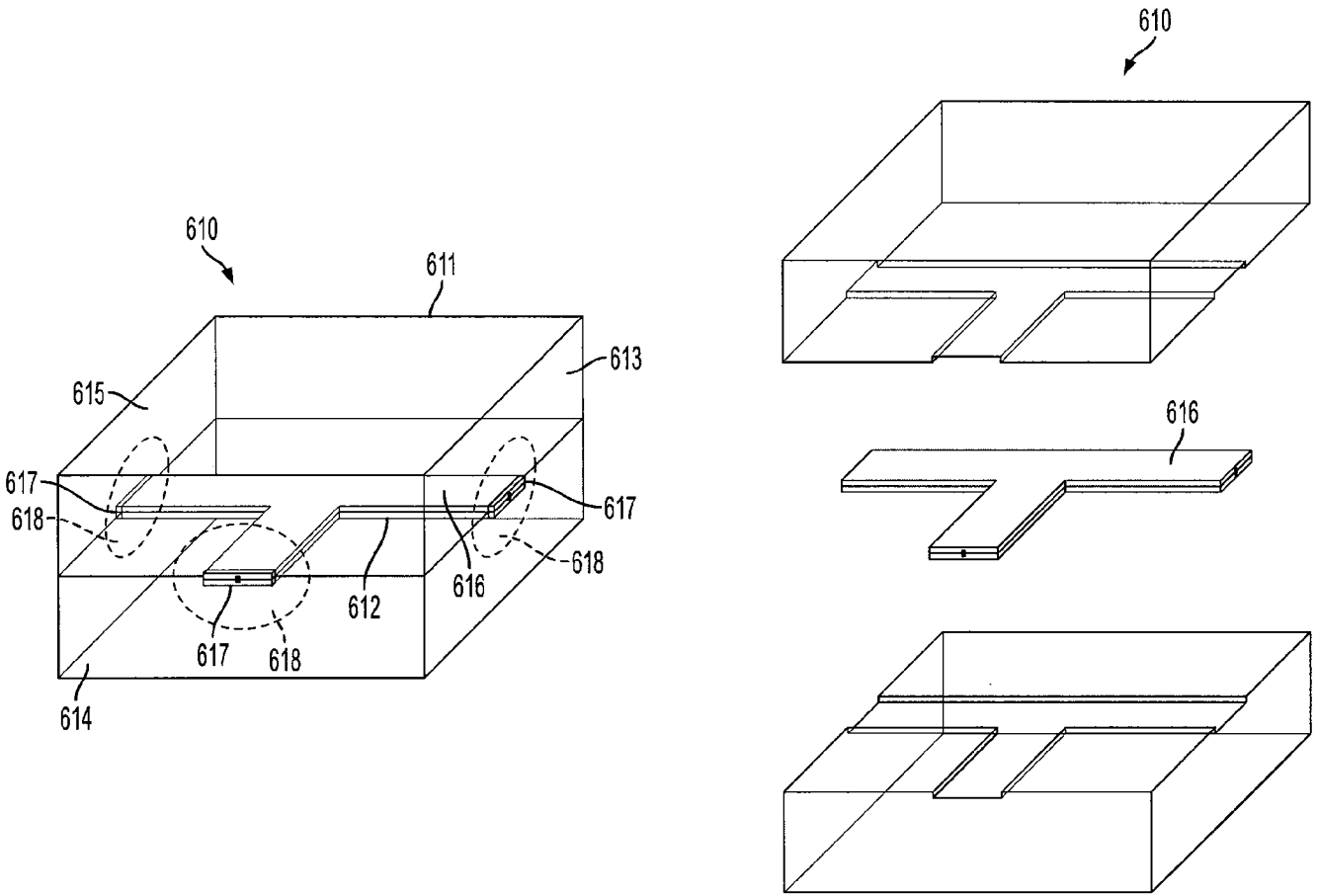
FIG. 6B shows a perspective view and an exploded view of a WGED with three access outlets according to an implementation of the present disclosure.

In FIG. 6B, the WGED 610 may have a precision channel 612 extending through the first, second, and third surfaces 613, 614, and 615 of the housing 611. As such, the waveguide component 616 may have a shape that matches the precision channel 612 and three contact portions 617 that extend beyond the first, second, and third surfaces 613, 614, and 615, thereby forming three access outlets 618.

Figure 6C:
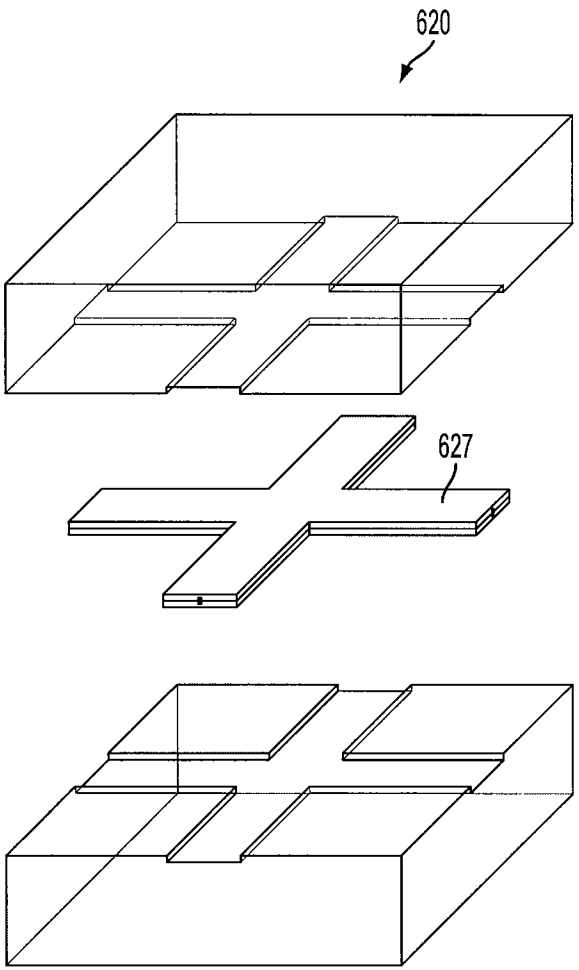
FIG. 6C shows a perspective view and an exploded view of a WGED with four access outlets according to an implementation of the present disclosure.
Figure 6C:
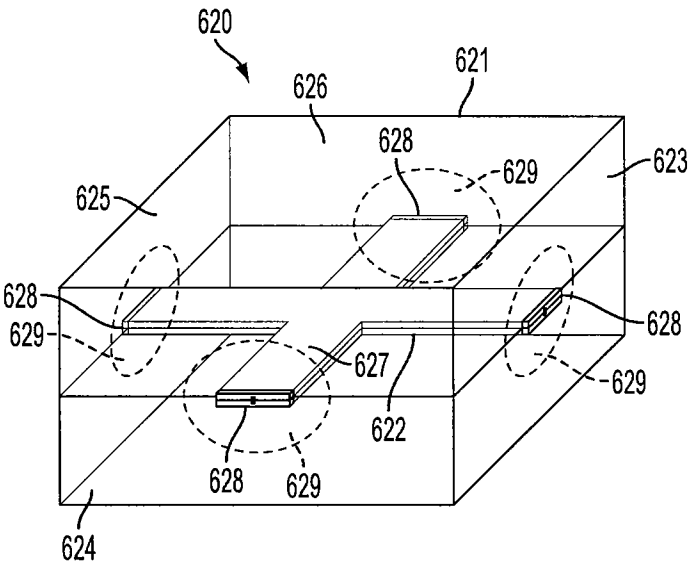

In FIG. 6C, the WGED 620 may have a precision channel 622 extending through the first, second, third and fourth surfaces 623, 624, 625 and 626 of the housing 621. As such, the waveguide component 627 may have a shape that matches the precision channel 622 and four contact portions 628 that extend beyond the first, second, third and fourth surfaces 623, 624, 625 and 626, thereby forming four access outlets 629.

Figure 6D:
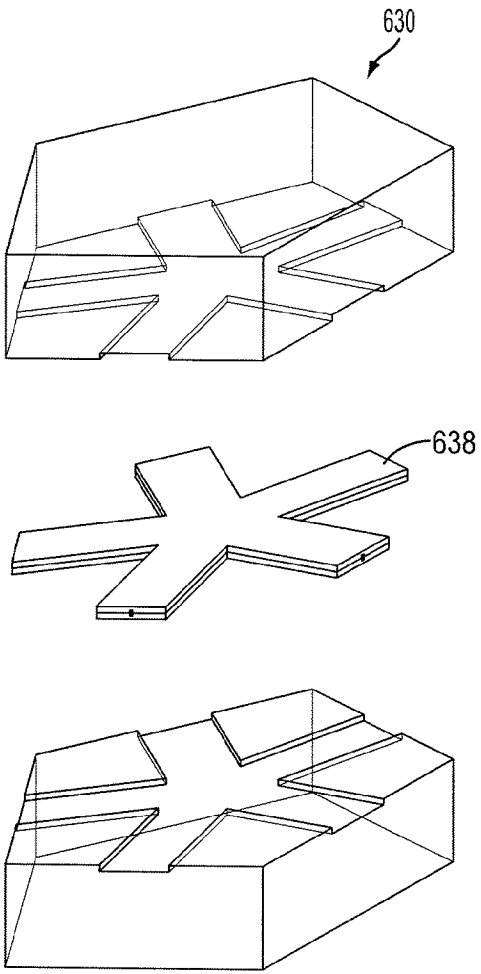
FIG. 6D shows a perspective view and an exploded view of a WGED with five access outlets according to an implementation of the present disclosure.
Figure 6D:
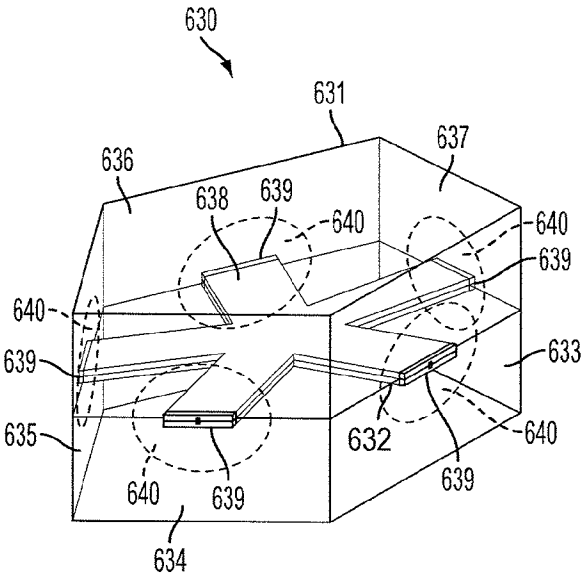

In FIG. 6D, the WGED 630 may have a precision channel 632 extending through the first, second, third, fourth and fifth surfaces 633, 634, 635, 636, and 637 of the housing 631. As such, the waveguide component 638 may have a shape that matches the precision channel 632 and five contact portions 639 that extend beyond the first, second, third, fourth and fifth surfaces 633, 634, 635, 636, and 637, thereby forming five access outlets 640.

Figure 6E:
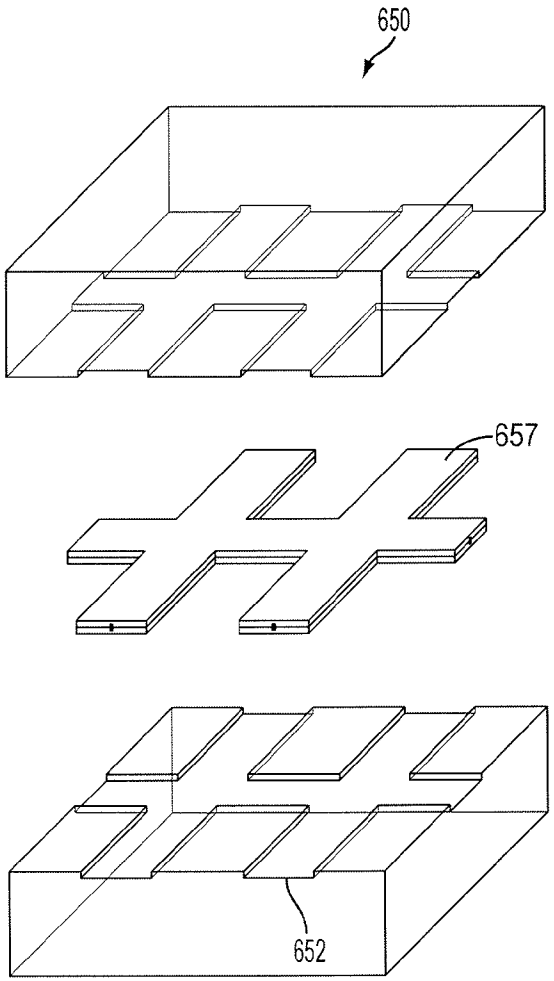
FIG. 6E shows a perspective view and an exploded view of a WGED with six access outlets according to an implementation of the present disclosure.
Figure 6E:
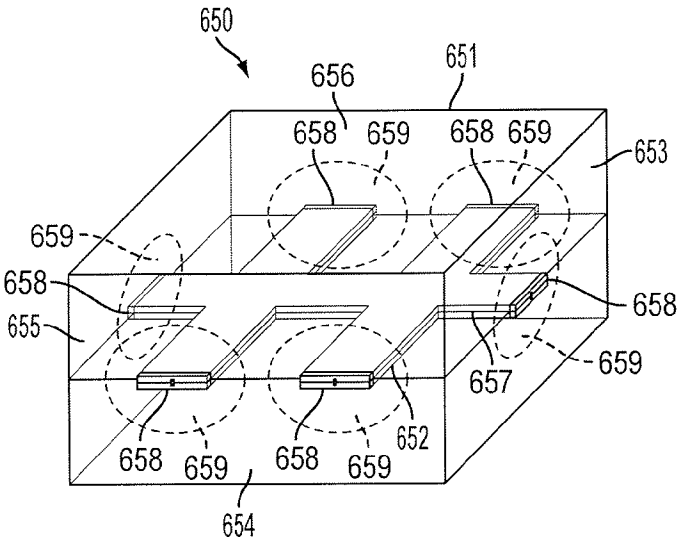

In FIG. 6E, the WGED 650 may have a precision channel 652 extending through the first, second, third, and fourth surfaces 653, 654, 655, and 656 of the housing 651. As such, the waveguide component 657 may have a shape that matches the precision channel 652 and six contact portions 658 that extend beyond the first, second, third, and fourth surfaces 653, 654, 655, and 656, thereby forming six access outlets 659.

The discussion now turns to various configurations for the WGED with two access outlets. In FIG. 7A, the WGED 700 may have two access outlets 701 and 702 disposed on the first and second surfaces 703 and 704. The first surface 703 may lie on a first plane 705, and the second surface 704 may lie on a second plane 706. According to an implementation of the present disclosure, the first plane 705 may be substantially parallel to the second plane 706, such that the front surfaces of the contact portions 707 and 708 of the waveguide component 709 are substantially parallel to each other.

Figure 7B:
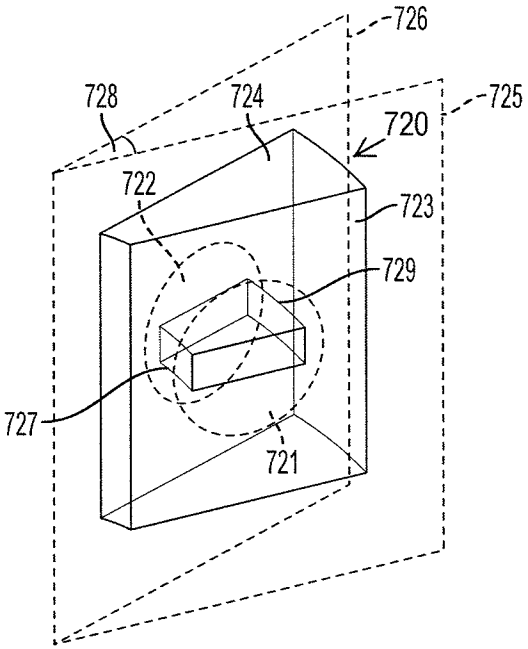
FIGS. 7A-7D show various configurations of a WGED according to various implementations of the present disclosure.
Figure 7A:
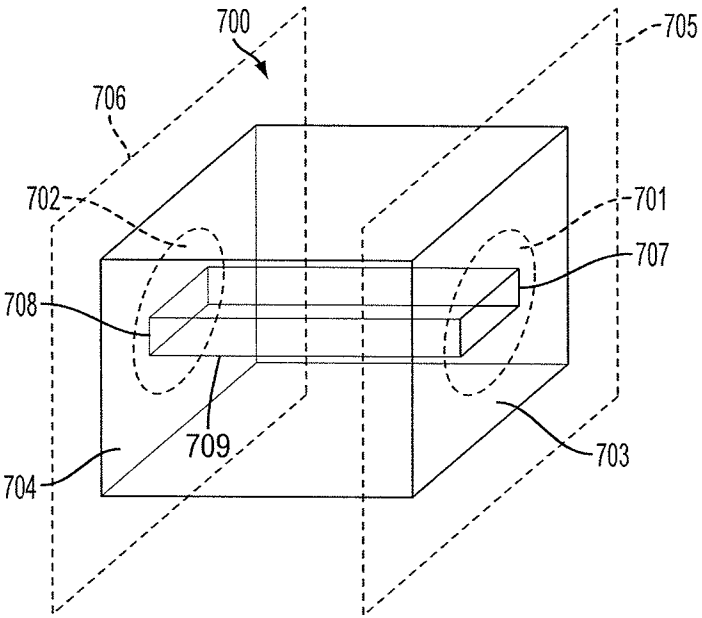

In FIG. 7B, the WGED 720 may have two access outlets 721 and 722 disposed on the first and second surfaces 723 and 724. The first surface 723 may lie on a first plane 725, and the second surface 724 may lie on a second plane 726. According to another implementation of the present disclosure, the first plane 725 may form an acute angle 728 with the second plane 726, such that the waveguide component 729 has a bent section 727.

Figure 7D:
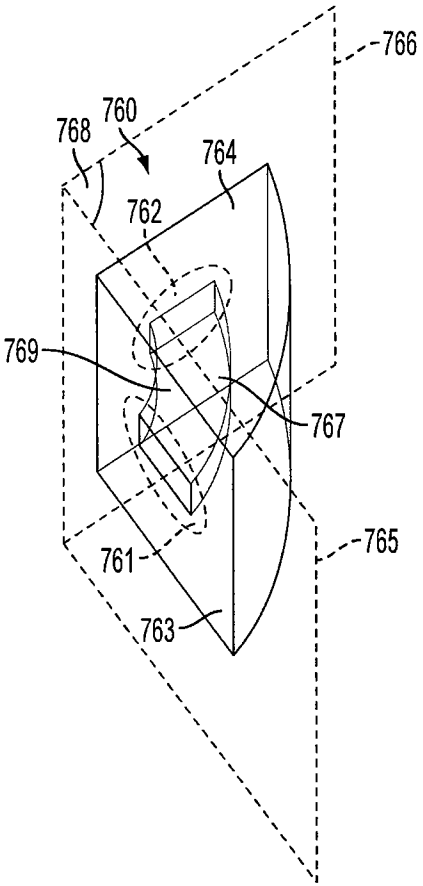
Figure 7C:
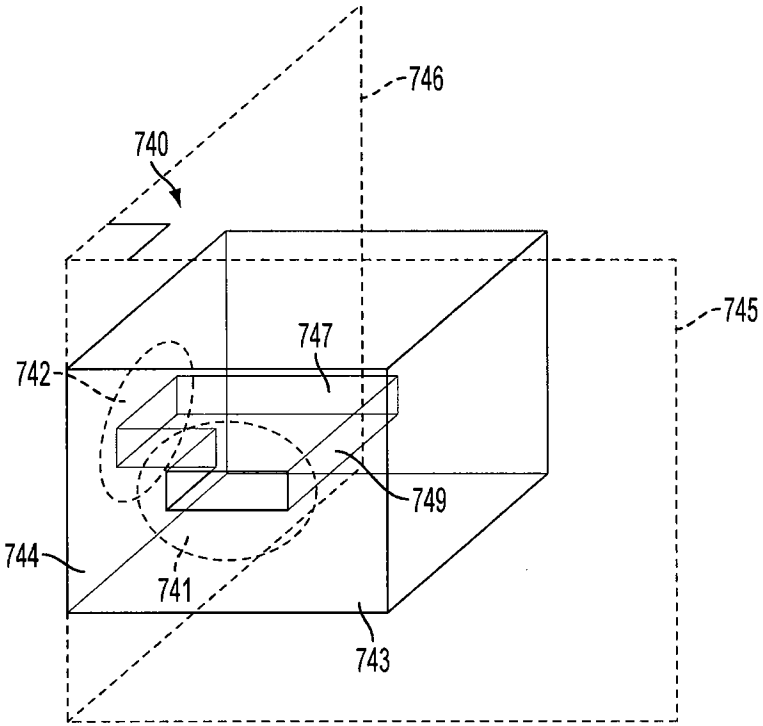

In FIG. 7C, the WGED 740 may have two access outlets 741 and 742 disposed on the first and second surfaces 743 and 744. The first surface 743 may lie on a first plane 745, and the second surface 744 may lie on a second plane 746. According to yet another implementation of the present disclosure, the first plane 745 may be substantially perpendicular to the second plane 746, such that the waveguide component 749 has a right-angled section 747.

In FIG. 7D, the WGED 760 may have two access outlets 761 and 762 disposed on the first and second surfaces 763 and 764. The first surface 763 may lie on a first plane 765, and the second surface 764 may lie on a second plane 766. According to yet still another implementation of the present disclosure, the first plane 765 may form an obtuse angle 768 with the second plane 766, such that the waveguide component 769 has a bent section 767.

Exemplary implementations of the disclosure have been disclosed in an illustrative style. Accordingly, the terminology employed throughout should be read in a non-limiting manner. Although minor modifications to the teachings herein will occur to those well versed in the art, it shall be understood that what is intended to be circumscribed within the scope of the patent warranted hereon are all such implementations that reasonably fall within the scope of the advancement to the art hereby contributed, and that that scope shall not be restricted, except in light of the appended claims and their equivalents.

What is claimed is:

1. A waveguide component encapsulation device comprising:

a housing having a first surface, the housing defining a channel extending through the first surface; and a waveguide component configured to be positioned in the channel, the waveguide component having a first end extending outside the channel and beyond the first surface of the housing by a finite length and capable of being compressed to be substantially coplanar with the first surface.

2. The device of claim 1, wherein:

the housing has a second surface, the first surface lies along a first plane and the second surface lies along a second plane, the channel extends through the second surface, and the waveguide component has a second end extending outside the channel and beyond the second surface of the housing by the finite length.

3. The device of claim 2, wherein the first plane forms an acute angle with the second plane.

4. The device of claim 2, wherein the housing has a third surface, the channel extending through the third surface, and wherein the waveguide component has a third end extending outside the channel and beyond the third surface of the housing by the finite length.

5. The device of claim 4, wherein the housing has a fourth surface, the channel extending through the fourth surface, and wherein the waveguide component has a fourth end extending outside the channel and beyond the fourth surface.

6. The device of claim 1, further comprising a spacing device positioned between the waveguide component and the channel of the housing, the spacing device configured to align and stabilize the waveguide component within the channel of the housing.

7. The device of claim 1, wherein the finite length is between about 5 μm to about 10 μm.

8. The device of claim 1, wherein the waveguide component is formed with a material selected from a group consisting of silicon, silica, quartz, alumina, silicon nitride, gallium arsenide, indium phosphide, micro-machined crystalline materials, metalized plastic, and combinations thereof.

9. The device of claim 8, wherein the waveguide component is a micromachined waveguide configured to conduct a signal having a frequency higher than about 30 GHz.

10. A waveguide component encapsulation device comprising:

a housing having first and second surfaces, the housing defining a channel extending through the first and second surfaces;

a micromachined waveguide component configured to be positioned in the channel, the waveguide component having first and second ends extending outside the channel and beyond the first and second surfaces of the housing by a finite length, the first and second ends capable of being compressed to be substantially coplanar with the first and second surfaces, respectively; and a pair of spacing members configured to align and stabilize the waveguide component within the channel.

11. The device of claim 10, wherein the finite length ranges from about 5 μm to about 10 μm, and wherein the micromachined waveguide component is formed with a material selected from a group consisting of silicon, silica, quartz, alumina, silicon nitride, gallium arsenide, indium phosphide, micro-machined crystalline materials, metalized plastic, and combinations thereof.

12. The device of claim 10, wherein the waveguide component is embedded with a MMW or THz circuit selected from a group consisting of a filter, a mixer, an oscillator, an amplifier, a high-power traveling wave tube amplifier, an exciter, a receiver, an imaging system and combinations thereof.

13. A waveguide component encapsulation device for use in conjunction with a flange having a flange surface and a connection port, the waveguide component encapsulation device comprising:

a first fixture having a plurality of first surfaces, the first fixture defining a first trench extending through at least one of the plurality of first surfaces;

a second fixture having a plurality of second surfaces, the second fixture defining a second trench extending through at least one of the plurality of second surfaces;

means for securing the first fixture to the second fixture, the first and second trenches combining to define a channel, and the first and second fixtures combining to form a front surface such that the channel extends through the front surface;

a waveguide component disposed within the channel, the waveguide component having a contact portion extending outside of the channel and beyond the front surface by a finite length, the contact portion capable of being compressed to be substantially coplanar with the front surface;

first and second spacers configured to align and stabilize the waveguide component inside the channel, the first spacer inserted between the first fixture and the waveguide component, the second spacer inserted between the second fixture and the waveguide component; and means for securing the waveguide component encapsulation device to the flange, the contact portion of the waveguide component configured to be coupled to and compressed by the connection port of the flange such that the front surface of the waveguide component encapsulation device is substantially in contact with the flange surface of the flange.

14. The device of claim 13, wherein the finite length is between about 5 μm to about 10 μm.

15. The device of claim 13, wherein the waveguide component is formed with a material selected from a group consisting of silicon, silica, quartz, alumina, silicon nitride, gallium arsenide, indium phosphide, micro-machined crystalline materials, metalized plastic, and combinations thereof.

16. The device of claim 15, wherein the waveguide component is a micromachined waveguide configured to conduct a signal having a frequency higher than about 30 GHz.

17. The device of claim 13, wherein the contact portion of the waveguide component is metalized for coupling to the connecting port of the flange.

18. The device of claim 13, wherein the waveguide component is embedded with a MMW or THz circuit selected from a group consisting of a filter, a mixer, an oscillator, an amplifier, a high-power traveling wave tube amplifier, an exciter, a receiver, an imaging system and combinations thereof.

19. The device of claim 13, wherein the front surface of the waveguide component encapsulation device has a bolt circle and a dowel pin, the bolt circle and the dowel pin configured to align the flange surface of the flange with the front surface of the waveguide component encapsulation device.

20. The device of claim 13, wherein the channel has a shape selected from a group consisting of a straight line strip, a zigzag strip, a curve strip, a multiple-split strip, an L-shape strip, a T-shape strip, a cross-shaped strip, a rectangular strip, and combinations thereof.

* * * * *